US007757518B2

(12) United States Patent
Sho et al.

(10) Patent No.: US 7,757,518 B2
(45) Date of Patent: Jul. 20, 2010

(54) SOCK

(75) Inventors: Kenji Sho, Nara (JP); Toshio Ando, Nara (JP); Shu Morioka, Nara (JP); Takahiko Fukumoto, Nara (JP); Hiroshi Maeoka, Nara (JP)

(73) Assignee: Okamoto Corporation, Kitakatsuragi-Gun, Nara (JP)

( * ) Notice: Subject to any disclaimer, the term of this patent is extended or adjusted under 35 U.S.C. 154(b) by 0 days.

(21) Appl. No.: 12/395,972

(22) Filed: Mar. 2, 2009

(65) Prior Publication Data

US 2009/0276939 A1 Nov. 12, 2009

(51) Int. Cl.
*A41B 11/00* (2006.01)

(52) U.S. Cl. ..... 66/185; 66/178 A

(58) Field of Classification Search ..... 66/178 R, 66/182, 185–188, 178 A; 2/239.241
See application file for complete search history.

(56) References Cited

U.S. PATENT DOCUMENTS 2,050,535 A * 8/1936 Martel ..... 66/178 R
2,219,235 A * 10/1940 Morton ..... 2/239
3,241,340 A * 3/1966 Knohl ..... 66/185
4,015,448 A * 4/1977 Knohl ..... 66/185
4,057,981 A * 11/1977 Runac ..... 66/185
4,522,044 A * 6/1985 Lineberry et al. ..... 66/185
5,103,656 A * 4/1992 Hanson, II ..... 66/185
5,319,807 A * 6/1994 Brier ..... 2/239
7,614,257 B2 * 11/2009 Araki et al. ..... 66/185

FOREIGN PATENT DOCUMENTS

JP 5-37218 U 5/1993
JP 2001-238992 A 9/2001
JP 2001-355101 A 12/2001

* cited by examiner

*Primary Examiner*—Danny Worrell
(74) *Attorney, Agent, or Firm*—Brinks Hofer Gilson & Lione

(57) ABSTRACT

A sock may include a first low-elasticity area disposed on a dorsal portion of the foot, the first low-elasticity area being band-shaped and having a lower elasticity than other areas of the sock. The first low-elasticity area may include a curved ankle portion and an end portion, the end portion being disposed below the curved ankle portion and extending to the base of the toes. The end portion may be positioned within a range from the base of the third toe to the base of the small toe. A center line in the course direction with respect to the width of the first low-elasticity area may gradually shift toward the side of the small toe in the course direction. Preferably, the first low-elasticity area applies a force that raises the side of the fifth toe toward the ankle curve portion thereby providing a resistive force against the ankle twisting inwards.

9 Claims, 8 Drawing Sheets

SOCK

RELATED APPLICATIONS

The present application claims priority to Japanese Patent Application Number 2008-125183, filed May 12, 2008, the entirety of which is hereby incorporated by reference.

TECHNICAL FIELD

The present invention relates to a sock which is able to prevent inversion sprains at the joints of the feet.

BACKGROUND ART

A sprain is a state in which injury occurs to a ligament or an area surrounding a joint when abnormal movement which exceeds the permissible range is applied to a movable portion of a joint. In the case of ankle sprains in particular, the outer side of the sole (the side of the small, or pinky toe) becomes immobilized on the ground, and the ankle is pushed to the outside, causing a forceful inward twisting of the bottom of the foot. Such inversion sprains are reported to account for 80-90% of ankle sprains.

When the ankle is in an inverted state, the part that is most readily injured is the anterior talofibular ligament which connects the talus and the fibula at the front of the lateral malleolus. Moreover, when force continues to be exerted, injury can occur to the calcaneofibular ligament or the posterior talofibular ligament at the outer side of the back of the ankle. Accordingly, if an inversion sprain occurs, the ligaments extending between the fibula, the talus, and the calcaneus are injured, resulting in swelling and pain accompanied by internal bleeding in the lateral malleolus, and there are many cases in which the weight of the body cannot be supported immediately after injury.

Accordingly, socks and supporters are conventionally used to prevent sprains. For example, Patent Reference 1 discloses a sprain-preventative sock which limits wobbling and twisting of the ankle beyond what is necessary, by interknitting yarns which contain elastic fibers having strong support, the yarns being disposed in a ring shape at the lower portion of the calf, at the upper part of the ankle, at the base of the instep, and at the base of the toes. An inelastic band is also provided which links the area from the inside and the outside of the calf to the tip of the foot, so as to pass through these ring shape portions longitudinally.

Patent Reference 1: Japanese Laid-Open Patent Application No. 2001-355101

Patent Reference 2 discloses a sock which prevents inversion sprains by sewing a pad which inclines upward from the side of the arch to the outer side of the foot into the inner surface of the sole portion of a sock.

Patent Reference 2: Japanese Laid-Open Utility Model Application No. H5-37218

Patent Reference 3 discloses a tool (brace) for preventing inversion sprains of the ankle, comprising an inflexible belt member wound around the sole to the instep and provided with a first hook-and loop fastener at a lower end, a fastener engaging part disposed at an upper end, a flexible abutting member whose front surface abuts a fastener engaging surface and whose back surface abuts a surface near the ankle when mounted, and a second hook-and loop fastener attached to the abutting member.

Patent Reference 3: Japanese Laid-Open Patent Application No. 2001-238992

However, in the sock of Patent Reference 1, the inflexible band from the inside and outside of the calf to the tip of the foot is designed only to be able to limit movement of the foot as much as possible in a straight line; the sock is not designed to produce a force to resist inward twisting of the foot. Thus, this sock does not provide any means for preventing inversion sprains.

Since the sock of Patent Reference 2 is provided with a pad on the inner surface of the sole portion that inclines upward from the side of the arch to the outer side, the foot is constantly constrained at an angle like a pigeon-toe, so that when a person walks for long periods of time, the weight of the body is always on the outer edges of the feet, thus resulting in the problem that pain and fatigue readily occur. Additionally, because the weight of the body is on the outer edges of the feet, the foot is readily susceptible to eversion, thus increasing the risk of eversion sprains.

In the tool for preventing inversion sprains disclosed Patent Reference 3, work is required to attach and detach the tool to the foot using the belt and the fasteners, and a problem exists in that it is uncomfortable to wear a sock on top of this tool. For elderly persons in particular, it is not easy for them to attach and detach the tool to their ankles, and additional problems exist in that the feet easily become fatigued, and there is a greater risk of stumbling and falling, since the flexible bending movement of the ankle is inhibited in a number of normal walking movements such as: "touching the heel to the ground"→"shifting the body weight forward when the sole of the foot touches the ground"→and "kicking off from the surface of the ground from the tips of the toes."

BRIEF SUMMARY

Socks are described below that may provide a resistive force against the ankle twisting inwards, thereby making it possible to effectively prevent inversion sprains. The invention may include any of the following aspects in various combinations and may also include any other aspect described below in the written description or in the attached drawings. In one aspect, the sock may include a first low-elasticity area disposed on a dorsal portion of the foot, the first low-elasticity area being band-shaped and having a lower elasticity than other areas of the sock. Preferably, the first low-elasticity area includes at least a curved ankle portion and an end portion, the end portion being disposed below the curved ankle portion and extending to the base of the toes. Preferably, the end portion is positioned within a range from the base of the third toe to the base of the small toe. A center line in the course direction with respect to the width of the first low-elasticity area may gradually shift toward the side of the small toe in the course direction.

In another aspect, a portion on a side of the small toe near the lower end of the first low-elasticity area extends to a sole side of the sock such that it wraps around a fifth metatarsal. In one embodiment, the sock may include a second low-elasticity area having lower elasticity than other areas of the sock, excluding the first low-elasticity area. The second low-elasticity area may extend from an instep side of the base of the fourth toe to the sole side so as to wrap around a fifth phalange and a fourth phalange. Preferably, a lower end of the first low-elasticity area is continuous with the second low-elasticity area.

In one aspect, the first low-elasticity area and the second low-elasticity area are knitted using tuck knitting. In another aspect, the width of the first low-elasticity area in the course direction when the sock is in an unworn configuration is in a range between about 4 centimeters to about 5 centimeters.

In another embodiment, the sock may include a third low-elasticity area having lower elasticity than other areas of the sock, excluding the first and second low-elasticity areas, the third low-elasticity area being disposed peripherally in the vicinity of a lower part of the calf. An upper end of the first low-elasticity area may be formed continuously with the third low-elasticity area.

In one aspect, the width of the third low-elasticity area is about 3 centimeters or more in the wale direction when the sock is in an unworn configuration.

In yet another embodiment, the sock may include a fourth low-elasticity area having lower elasticity than other areas of the sock, excluding the first, second, and third low-elasticity areas, the fourth low-elasticity area being disposed peripherally in the vicinity of the lower part of the calf. The lower end of the first low-elasticity area may be formed continuously with the fourth low-elasticity area.

In one aspect, the sock may include at least two toe pouches in a toe portion, and the toe portion and a heel portion may each knitted with pile knitting. In another embodiment, the sock may include an area having an increased course number that encloses a ball of the foot on the sole side of the sock, the area having an increased course number being pile knitted.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PREFERRED EMBODIMENTS

Figure 1:
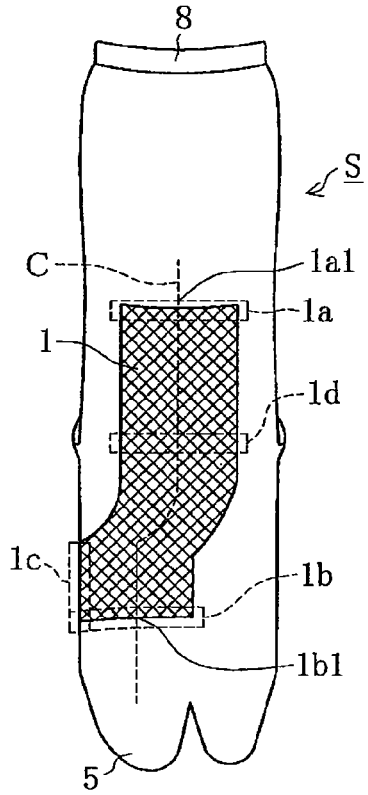
FIG. 1 is a drawing illustrating the dorsal side of a sock of Example 1 provided only with a first low-elasticity area.

The sock of the present invention is provided with a band-shaped first low-elasticity area on the dorsal portion of the foot and having lower elasticity than other areas, and is characterized in that this first low-elasticity area includes at least the curved ankle portion, and the end side of the first low-elasticity area which is disposed below the ankle bending portion and extends to the base of the toes so that the center line with respect to the width in the course direction gradually shifts toward the side of the small toe, and the lower end portion is positioned within a range from the base of the third toe to the base of the small toe.

In the present invention, the elastic welt side of the sock is referred to as "upper" and the toe portion side is referred to as "lower." Therefore, "the end side which is lower than the ankle bending portion" signifies a portion closer to the toe portion side than the ankle bending portion. Furthermore, "lower end portion" signifies the end portion of the toe portion side, within the first low-elasticity area.

"Ankle bending portion" refers to a site where the ankle bends at a position at the base of the instep. The first low-elasticity area of the present invention includes at least the ankle bending portion. That is to say, the upper end of the first low-elasticity area is at the curved bending portion or at a position higher than the ankle bending portion (on the elastic welt side).

The first low-elasticity area includes at least the ankle bending portion. The end side of the first low-elasticity area which is lower than the ankle bending portion, is disposed extending to the base of the toes, so that the center line against the width of the first low-elasticity area in the course direction gradually shifts toward the side of the small toe, and the lower end portion is positioned within a range from the base of the third toe to the base of the small toe. Accordingly, in the present invention, the first low-elasticity area suitably raises the side of the small toe toward the ankle bending side, thereby making it possible to effectively prevent inversion sprains.

In the present invention, the portion on the side of the small toe near the lower end of the first low-elasticity area is more preferably provided extending to the sole side, so that it wraps around the fifth metatarsal. In accordance with such a construction, a force is produced which raises the side of the small toe as a whole, by hanging the side of the small toe near the lower end of the first low-elasticity area on the fifth metatarsal, thereby enhancing the effect of preventing inversion sprains.

Furthermore, in the present invention, a second low-elasticity area is provided with lower elasticity than other areas, and extending from the instep side of the base of the fourth toe to the sole side, so as to wrap around the fifth phalange and the fourth phalange. It is more desirable that the lower end of the first low-elasticity area be continuous with the second low-elasticity area. By providing such a second low-elasticity area, it becomes possible to firmly raise the portion of the small toe as a whole, including the fifth phalange and the fourth phalange, thereby making it possible to further enhance the effect of preventing inversion sprains.

The low-elasticity areas of the present invention are formed by causing the elasticity to be lower than other areas. Specifically, this is accomplished by (1) a method for adjusting elasticity by selecting yarns which are used, such as thickening the back yarns or adding or inserting an elastic material such as polyurethane or rubber; (2) a method for adjusting elasticity by knitting methods, such as knitting with a fabric that does not readily stretch, using tuck knitting or the like, and increasing the stitch density of the knitted fabric; or (3) a method of reducing elasticity such as depositing a resin. In the present invention, the term "low-elasticity area" includes "inelastic areas" which do not substantially stretch.

Of the above three methods, the method of reducing elasticity by depositing a resin has the drawback of a feeling of discomfort when the sock is worn. In order to obtain a feeling of comfort, the method of adjusting elasticity by selecting the yarns which is used, or the method of adjusting by the knitting method is used, or these two methods are used together.

When elasticity is adjusted by selecting the yarns which are used, and the elasticity is limited to some degree thereby improving the fit of the sock. By contrast, when elasticity is adjusted by the knitting method, it is possible to enhance the effect of limiting the elasticity more than by adjusting by selecting the yarns which are used. Specifically, tuck knitting can be used as the knitting method.

Accordingly, in the present invention, it is desirable that the first low-elasticity area and the second low-elasticity area be knitted using tuck knitting. Elasticity of the first and second low-elasticity areas should be as low as possible, so that the effect of preventing inverse sprains will be significant. It is more desirable to insert wooly nylon yarns after the tuck knitting.

The width of the first low-elasticity area in the course direction when the sock is not worn is more desirably the range between 4 cm or more and 5 cm or less. As described above, the first low-elasticity area passes through at least the curved ankle portion in the upper end side, and is disposed inclined toward the small toe side in the lower side, thereby making it possible to impart a force to prevent inversion. However, as the width of this first low-elasticity area becomes less than 4 cm in the course direction, the force imparted to prevent inversion of the ankle weakens, thereby gradually increasing the risk of preventing an inversion sprain. On the other hand, as the width of the first low-elasticity area in the course direction becomes wider than 5 cm, then the user will gradually feel pressure when wearing the sock and it may become difficult to put on and take off the sock. Note that the range of between 4 cm and 5 cm was obtained as a result of repeated trial and error on the part of the inventors.

The basic structure of one embodiment of the present invention involves providing the first low-elasticity area as described above, but in order to obtain reliable effects when walking and exercising for long periods of time, it is important to prevent slipping of the first low-elasticity area, and to constantly maintain it in the correct position.

Accordingly, in the present invention, it is desirable that a third low-elasticity area, having lower elasticity than other areas, be provided peripherally in the vicinity of the lower part of the calf, and for an upper end of the first low-elasticity area to be formed continuously with the third low-elasticity area. Consequently, the third low-elasticity area performs the role of a taping anchor, making it possible to prevent the upper end of the first low-elasticity area from slipping down or slipping to the left and right, thereby supporting the inversion sprain preventative effect provided by the first low-elasticity area when walking or exercising for long periods of time.

When such a third low-elasticity area is provided, it is desirable that the width of the third low-elasticity area be 3 cm or more in the wale direction when the sock is not being worn. Although the width of the third low-elasticity area can vary depending on the shape and thickness of the wearer's leg, if the width is less than 3 cm, on the average, the anchor function is not sufficiently achieved, and there is a greater probability that the first low-elasticity area will slip down. If the width is 3 cm or more, the anchor effect preventing the first low-elasticity area from slipping down is achieved, so in this aspect there is no particular upper limit on the width of the third low-elasticity area.

For the same reasons given above, in the present invention, in one embodiment it is desirable that a fourth low-elasticity area with lower elasticity than other areas be provided peripherally in the vicinity of the base of the toes, and that the lower end of the first low-elasticity area be formed continuously with the fourth low-elasticity area. Consequently, the fourth low-elasticity area serves as a taping anchor, making it possible to prevent the upper end of the first low-elasticity area from slipping down or slipping to the left and right, thereby preventing slipping of the lower end portion of the first low-elasticity area to the right and left.

In the present invention, "other areas" refers to areas other than those provided by the first through the fourth low-elasticity areas.

The sock of the present invention may have a toe portion without any pouches for individual toes, as in an ordinary sock, but if the wearer walks or exercises for long periods of time, the toe portion can rotate in the course direction, and the position of the first low-elasticity area can shift.

Accordingly, in one embodiment of the present invention, it is more desirable to provide at least two toe pouches in the toe portion. By providing pouches for individual toes, it is possible to limit rotation of the toe portion in the course direction, and to maintain the position of the first low-elasticity area. The greater the number of individual toe pouches, the greater the limiting effect on rotation of the toe portion. However, if two toe pouches are provided, a sufficient rotation-limiting effect may be obtained. From the standpoint of ease of putting on and taking off the sock, as well as manufacturing, a bifurcated structure provided with two toe pouches is most desirable.

In the present invention, it is desirable that the toe portion and the heel portion each be knitted with pile knitting. If the heel portion, upon which the pressure of body weight is applied when it touches the ground, and the toe portion, upon which the pressure of body weight is applied when it kicks off the ground, are both knit with a pile knit structure, then it is possible to reduce the fatigue by walking and exercising. The risk of inversion sprains increases when the walking rhythm gradually deteriorates due to foot fatigue when walking or exercising for long periods of time, thus reducing foot fatigue is indirectly linked to reducing the risk of inversion sprains.

In the sock of the embodiments of the present invention described above, it is important to provide support so that the position of the first low-elasticity area does not slip. However, since the ball of the foot on the sole is a rounded pad which projects outwards and is a part that bends while walking, if the portion for the ball of the foot is knitted in a flat configuration, a user may experience a stretching feeling, and in some cases, this configuration causes the fabric to stretch and the position of the first low-elasticity area may slip.

Accordingly, in the present invention, it is more desirable to provide an area with an increased number of knitted courses, so as to enclose the ball of the foot, and also to pile knit the area having the increased number of courses. If this is done, there is no longer a stretching feeling of the fabric which runs along the shape of the ball of the foot, thereby making it possible to support the position of the first low-elasticity area. In addition, by pile knitting the area having the increased number of courses, it becomes possible to reduce foot fatigue when walking or exercising for long periods of time.

As described above, it is also possible to reduce elasticity in the first through the fourth low-elasticity areas by depositing a resin, but from the standpoint of productivity, comfort, and ease of putting on and taking off the sock, it is better to knit the first through the fourth low-elasticity areas using a knit fabric at the same time that the sock as a whole is knit.

As described above, with regard to the first and second low-elasticity areas, it is desirable to strongly limit the elasticity by knitting with tuck knitting. However, with regard to the third and fourth low-elasticity areas, which are provided to prevent the position of the first and second low-elasticity areas from slipping, it is better to simply insert an elastic material such as wooly nylon yarns or rubber yarns, rather than to adjust the elasticity by changing the method of knitting. In order to achieve the object of the present invention, it is sufficient to strongly limit the elasticity of the first and second low-elasticity areas. In the case of elderly individuals, it is preferred to make every effort to eliminate any excess feeling of compression.

EXAMPLES

Figure 2:
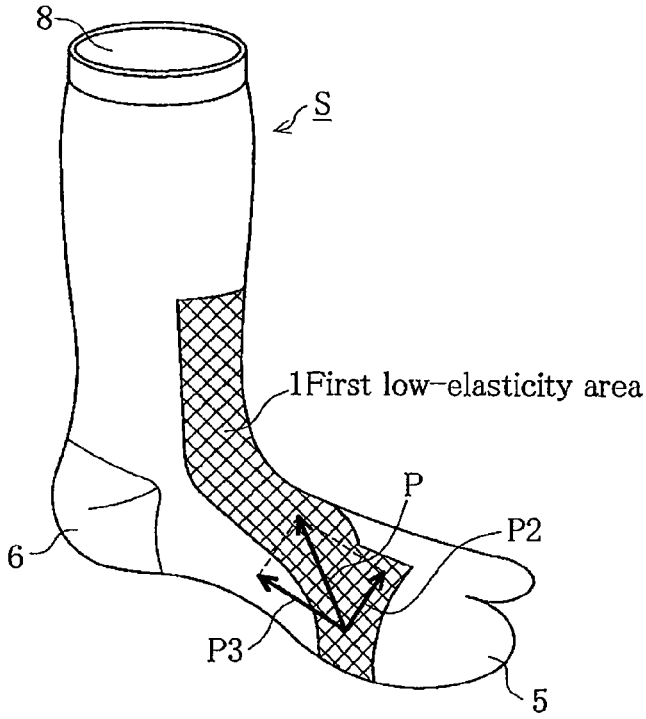
FIG. 2 is a perspective view of a sock of Example 1.
Figure 3:
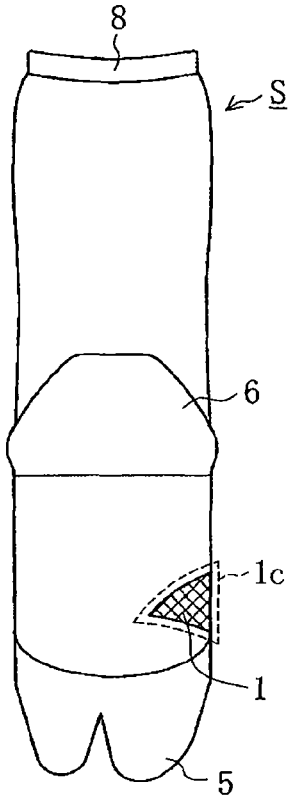
FIG. 3 is a drawing illustrating the sole side of a sock of Example 1.
Figure 4:
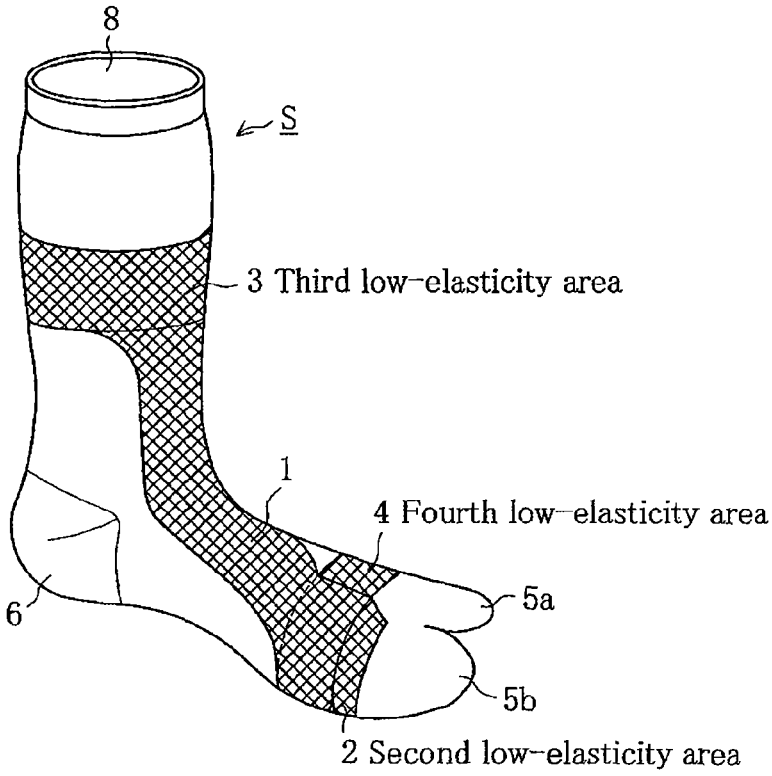
FIG. 4 is a perspective view of Example 2 (preferred embodiment of the present invention) provided with a first low-elasticity area through a fourth low-elasticity area.
Figure 5:
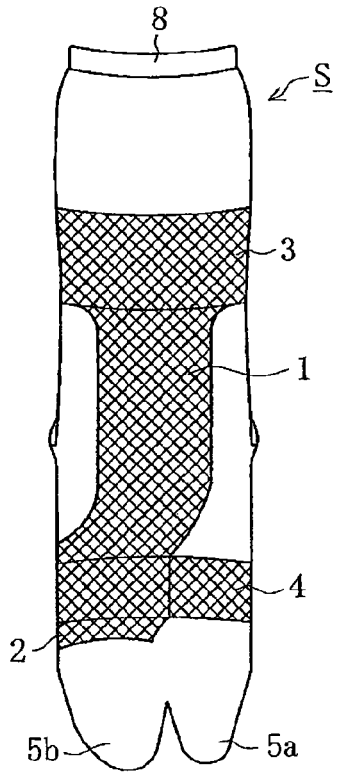
FIG. 5 is a drawing illustrating the dorsal side of a sock of Example 2.
Figure 6:
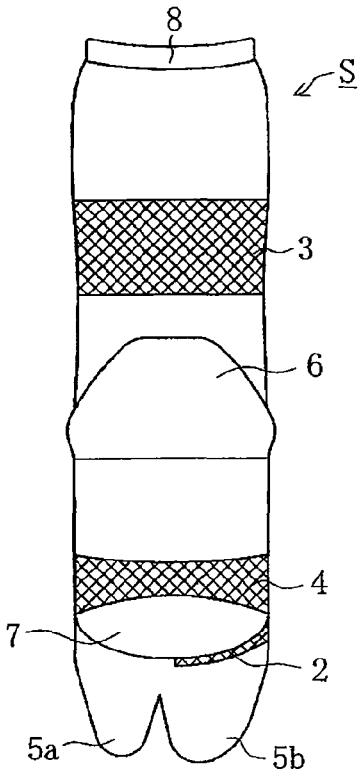
FIG. 6 is a drawing illustrating the sole side of a sock of Example 2.
Figure 7:
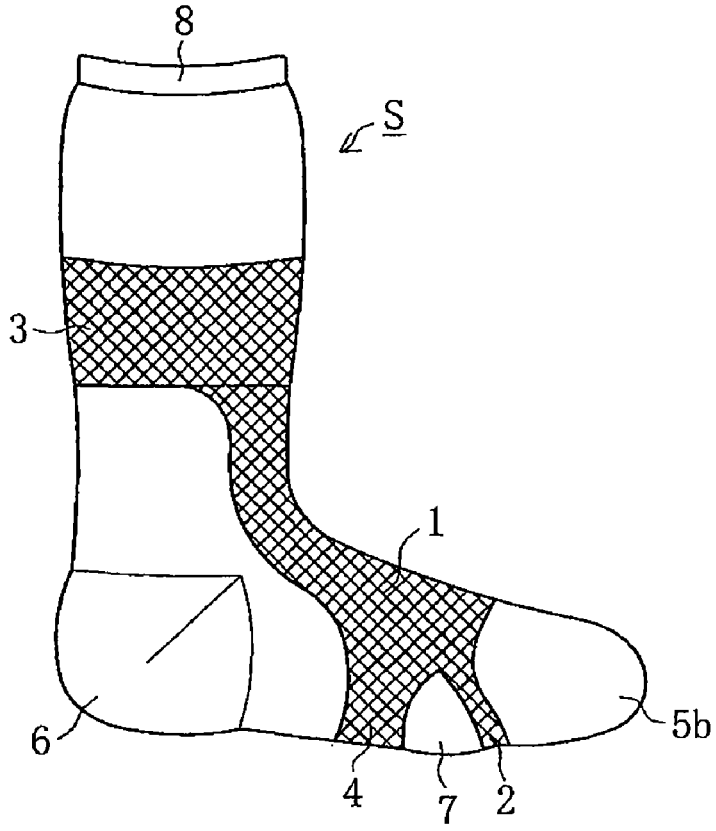
FIG. 7 is a drawing illustrating a side view of a sock of Example 2.
Figure 8:
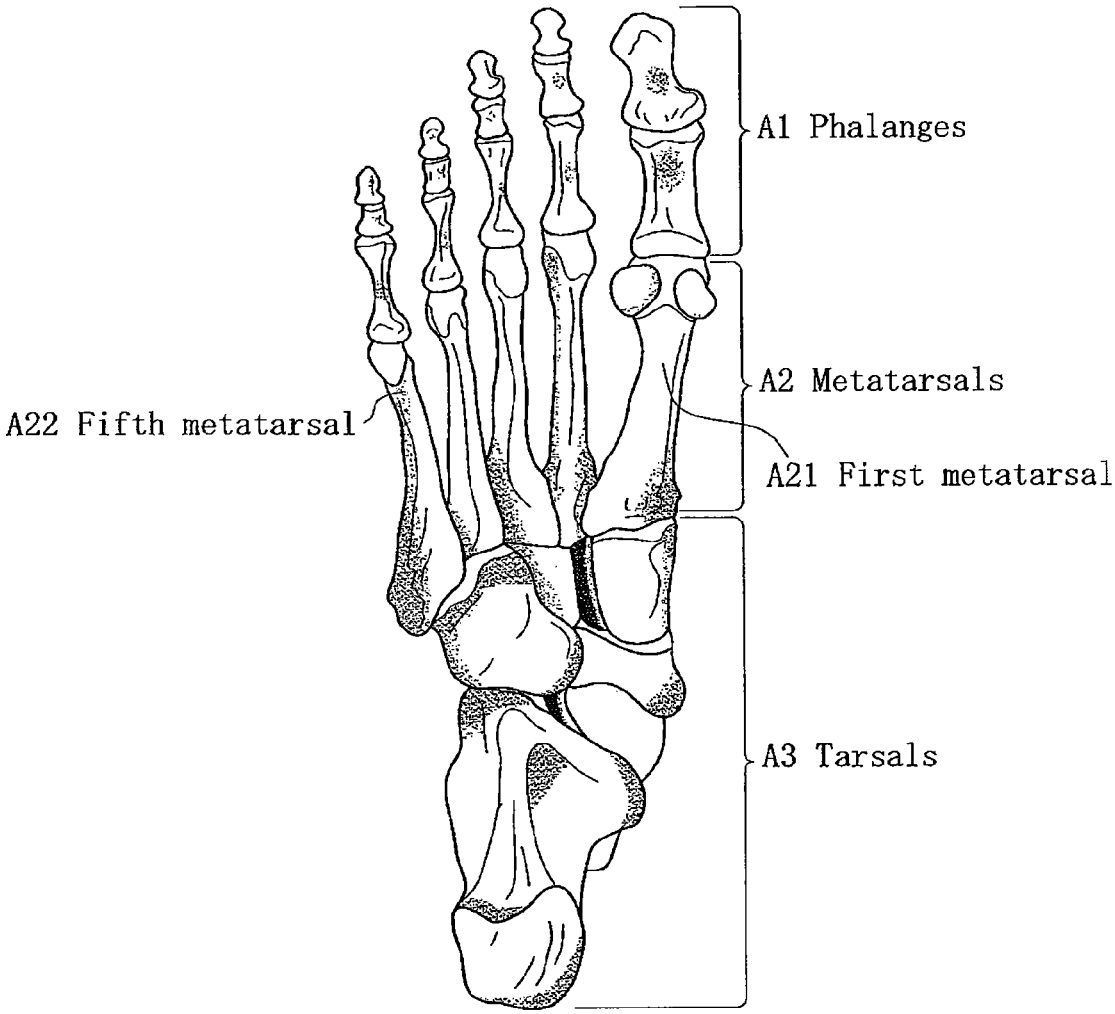
FIG. 8 is a drawing illustrating the bones of a right human foot as seen from the sole side.
Figure 9:
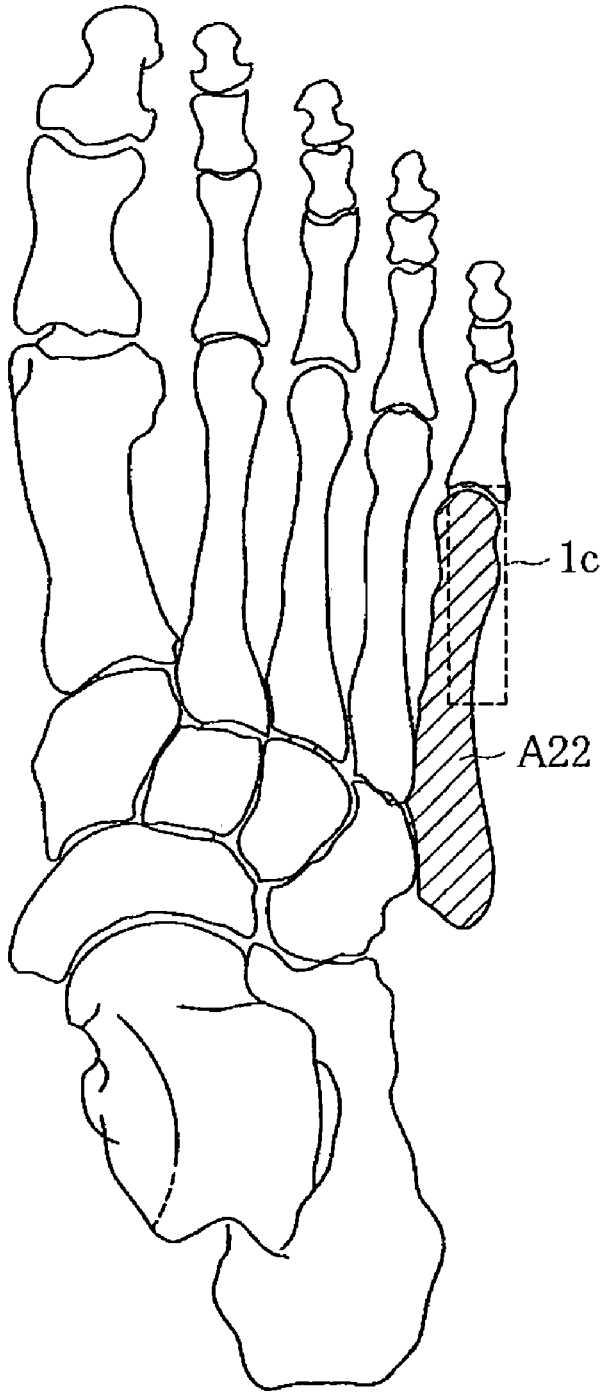
FIG. 9 is a drawing illustrating the bones of a right human foot as seen from the dorsal side.

The sock of the present invention is described in further detail below using examples. FIG. 1 is a drawing illustrating the dorsal side of a sock of Example 1 provided only with a first low-elasticity area. FIG. 2 is a perspective view of a sock of Example 1. FIG. 3 is a drawing illustrating the sole side of a sock of Example 1. FIG. 4 is a perspective view of Example 2 (preferred embodiment of the present invention) provided with a first low-elasticity area through a fourth low-elasticity area. FIG. 5 is a drawing illustrating the dorsal side of a sock of Example 2. FIG. 6 is a drawing illustrating the sole side of a sock of Example 2. FIG. 7 is a drawing illustrating a side view of a sock of Example 2. FIG. 8 is a drawing illustrating the bones of a right human foot as seen from the sole side. FIG. 9 is a drawing illustrating the bones of a right human foot as seen from the dorsal side.

Sock S of Example 1 was knitted using an ordinary single-cylinder K-type sock knitting machine to form a continuous unified whole, from an elastic welt 8 to a toe portion 5. Reference Numeral 1 is a band-shaped first low-elasticity area provided on the dorsal portion of the sock S. It may be knitted by tuck knitting, using 220 D wooly nylon yarns as the front yarns, and may have lower elasticity than other areas. Areas other than the first low-elasticity area may use 32/-cotton acrylic spun yarns as the front yarns. The back yarns preferably all use 30/75 ester wound FTY.

In FIG. 1, 1*d* represents the curved ankle portion, and 1*b* represents the lower end portion of the first low-elasticity area 1. The dotted line C represents a center line with respect to the width of the course direction of the first low-elasticity area 1. As shown in FIG. 1, the dorsal portion of the sock of Example 1 is provided with a band-shaped first low-elasticity area 1 having lower elasticity than other areas. This first low-elasticity area 1 may include at least the curved ankle portion 1*d*, and the end side of the first low-elasticity area which is disposed lower than the curved ankle portion 1*d* and extends to the base of the toes, so that the center line C with respect to the width of the course direction of the first low-elasticity area gradually shifts toward the side of the small toe. The lower end portion 1*b* is positioned in a range from the base of the third toe to the base of the small toe (fifth toe).

If the first low-elasticity area 1 includes at least the ankle curve portion 1*d*, then the advantageous effects of the present invention are achieved, thus making it possible to set the position of the curved ankle portion 1*d* at the upper end of the first low-elasticity area 1. However, it is desirable to suspend it slightly higher, so as to prevent the position of the first low-elasticity area 1 from slipping due to bending of the ankle. Thus, as shown in FIG. 1, in Example 1, the configuration is such that the upper end 1*a* of the first low-elasticity area 1 is positioned 5 cm above the curved ankle portion 1*d*.

Using the configuration shown in FIG. 2, the lower end portion 1*b*, which is positioned between the base of the third toe and the base of the small toe, is able to exert a pulling force (P) toward the curved ankle portion 1*d*, following the orientation of the first low-elasticity area 1. When this force P is divided into a vector in the right-left direction (course direction) and a vector in the vertical direction (wale direction), as represented by P2 and P3 of FIG. 2, respectively, this force is then understood to be exerted in an inversion-preventing direction (P2) and in dorsiflexion support direction (P3). Reference Numeral 6 represents a heel portion of the sock S.

Here, focusing on the position of a center portion 1*b*1 of the lower end portion 1*b* of the first low-elasticity area 1, the more the position of the center portion 1*b*1 in the lower end portion is caused to shift toward the base of the third toe, the weaker the force exerted in the inversion-preventing direction (P2), and the stronger the force exerted in the dorsal support direction (P3). If the center portion 1*b*1 in the lower end is positioned at the base of the third toe, then inclination in the right-left direction completely disappears, and the force is exerted only in the dorsal support direction (P3). In order to obtain an effective inversion sprain preventative function, it is desirable to provide the lower end center portion 1*b*1 of the first low-elasticity area 1 in a position corresponding to the base of the fourth toe. The sock of Example 1 is formed with such a structure.

As shown in FIG. 1, the center portion 1*a*1 of the upper end portion 1*a* of the first low-elasticity area 1 corresponds to the center portion of the anticnemion portion of the foot, and does not shift either to the right or to the left.

In FIG. 1, 1*c* represents a side portion on the small toe (fifth toe) side near the lower end of the first low-elasticity area. As can be seen from FIG. 3, which shows a view from the sole side of the foot, in sock S of Example 1, the side portion 1*c* on the small toe side near the lower end of the first low-elasticity area 1 extends to the bottom of the foot so as to wrap around the fifth metatarsal.

FIG. 8 is a view of the bones of a right human foot as seen from the sole. As shown in FIG. 8, the bones forming the human foot are broadly divided into the phalanges A1, the metatarsals A2, and the tarsals A3. The metatarsal (A21) on the big toe side is referred to as the first metatarsal, and the metatarsal (A22) on the small toe side is referred to as the fifth metatarsal.

FIG. 9 is a view of the bones of a human right foot as seen from the dorsal side of the foot. The drawing shows that there is an overlap between the fifth metatarsal A22 and the position of the side portion 1*c* on the small toe side near the lower end of the first low-elasticity area 1.

Thus, in the present invention, it is desirable for the side portion 1*c* on the small toe side near the lower end of the first low-elasticity area 1 to extend so as to wrap around the fifth metatarsal A22. If configured in this manner, a force is produced which raises the entire small toe side of the foot due to the fact that the side portion 1*c* on the small toe side near the lower end of the first low-elasticity area 1 engages with the fifth metatarsal A22, thereby enhancing the inversion sprain preventative effect.

FIG. 4 describes the structure of a sock of Example 2, which is provided with a second low-elasticity area 2, a third low-elasticity area 3, and a fourth low-elasticity area 4, in addition to the first low-elasticity area in the sock of Example 1.

As shown in FIG. 5 and FIG. 6, sock S of Example 2 is additionally provided with a second low-elasticity area 2 having lower elasticity than other areas, and that extends from the base of the fourth toe on the instep side to the sole side so as to wrap around the fifth phalange and the fourth phalange. Preferably, the second low elasticity area 2 is formed so that the lower end of the first low-elasticity area 1 is continuous with the second low-elasticity area 2. Providing the second low-elasticity area 2 produces a force which firmly elevates the entire portion of the foot on the side of the small toe, including the fifth phalange and the fourth phalange, thereby further enhancing the inversion sprain preventative effect.

Tuck knitting with low elasticity may be used as the knitting method for both the first low-elasticity area 1 and the second low-elasticity area 2. Additionally, wooly nylon yarns may be inserted to limit elasticity. Since the first and second low-elasticity areas have a direct effect in a direction which prevents inversion, reducing elasticity as much as possible elicits a significant inversion sprain preventative effect.

In this example, the width of the first low-elasticity area 1 in the course direction is set at 4.5 cm when the sock is not worn. This width is selected with consideration given to a balance among a force exerted in a direction that prevents inversion, a feeling of compression when the sock is worn, and ease of putting on and taking off the sock. An explanation as to why it is desirable for the width to be in a range between 4 cm or more and 5 cm or less has been discussed above.

As shown in FIG. 5 and FIG. 6, sock S of Example 2 is constructed so that a third low-elasticity area 3 with lower elasticity than other areas is disposed peripherally in the vicinity of the lower part of the calf, such that the upper part of the first low-elasticity area 1 is continuous with the third low-elasticity area 3. Consequently, the third low-elasticity area 3 serves as an anchor, making it possible to prevent the upper end of the first low-elasticity area from slipping down or from slipping to the right or left, thereby supporting the inversion sprain preventative effect provided by the first low-elasticity area 1 when walking and exercising for long periods of time.

The width of the third low-elasticity area 3 is 4 cm in the wale direction of the third low-elasticity area when the sock is not worn. As discussed above, if the width is 3 cm or greater, then an anchoring effect is achieved, but consideration was given to avoiding an unnecessary feeling of compression when the sock is worn, and consideration was also given to making it easy to put on and take off the sock, so the width was set at 4 cm. Elasticity of the third low-elasticity area 3 is kept suitably low by inserting wooly nylon yarns.

For the same reasons as given above, sock S of Example 2 is constructed so that a fourth low-elasticity area 4 with elasticity lower than other areas is also provided, the fourth low-elasticity area 4 being disposed peripherally in the vicinity of the base of the toes such that the lower end of the first elasticity area 1 is continuous with the fourth low-elasticity area 4. Consequently, the fourth low-elasticity area 4 serves as an anchor, making it possible to prevent the lower end portion of the first low-elasticity area from slipping to the right or left. Elasticity of the fourth low-elasticity area 4 may be kept suitably low by inserting wooly nylon yarns.

As shown in FIG. 5 and FIG. 6, sock S of this example has a bifurcated structure for the toe portion, with toe pouch 5*a* for the big toe and toe pouch 5*b* for the other toes. Providing the toe pouches 5*a* and 5*b* limits rotation of the toe portion in the course direction, and also makes it possible to maintain the position of the first low-elasticity area 1 when exercising vigorously. The number of toe pouches may be three or more, and as the number of toe pouches is increased, the greater the preventative effect on rotation of the toe portion becomes. However, in one embodiment if two toe pouches are provided, a sufficient rotation preventative effect may be achieved. When factors such as ease of putting on and taking off the sock, as well as productivity are considered, the most desirable structure is that of Example 2, which is provided with two toe pouches.

In the sock S of Example 2, the toe pouches 5*a* and 5*b*, and the inner surface of heel portion 6 may be knit with pile knitting. Since a pile knit cushion absorbs shock while walking or exercising, it makes it possible to reduce foot fatigue.

FIG. 7 is a side view of sock S of Example 2 as seen from the side of the small toe. The sock S of Example 2 is provided with an area with increased course number 7 which has a fabric with an increased course number so as to enclose the ball of the foot on the sole. The inner surface of the area with increased course number 7 is pile knitted. The increased course number should be large enough to enclose the ball of the foot as a whole. However, if it is too large, then care must be taken since sagging could occur, and this would interfere with walking and exercise. If it is too small, then there would be no effect of eliminating the stretching feeling. In this example, the fabric was increased by 40 courses for a sock in a man's size, and by 36 courses in a sock in a woman's size.

Accordingly, since the area with increased course number 7 runs along the shape of the ball of the foot, and since the feeling of stretching of the fabric is eliminated, it is possible to support the position of the first low-elasticity area 1. In addition, since the area with increased course number 7 is pile knitted, foot fatigue can be reduced, even when walking and exercising for long periods of time.

Figure 10:
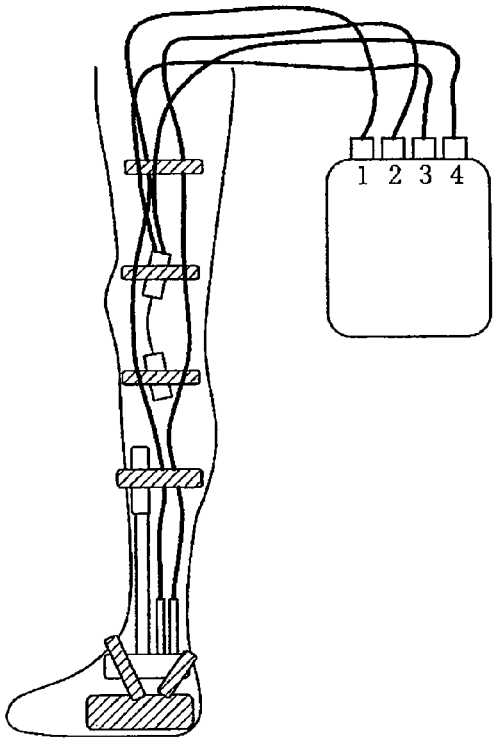
FIG. 10 is a drawing showing the positions where an electrogoniometer is attached in a joint angle measurement test performed while walking.
Figure 11:
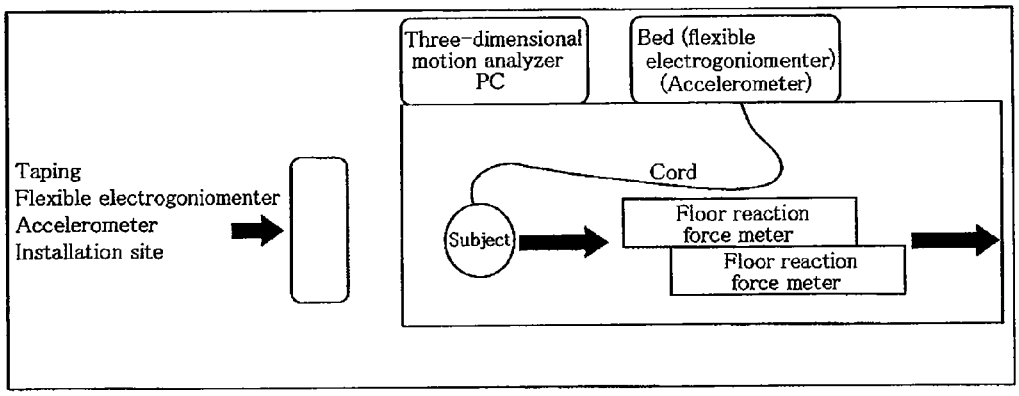
FIG. 11 is a diagram illustrating the direction of walking of the subject and other elements of a joint angle measurement test performed while walking.

The following is an explanation of a joint angle measurement test performed while walking to confirm the advantageous effects of the sock of the present invention. In this test, an electrogoniometer is attached to the outer surface of the left lower limb of the subject, as shown in FIG. 10, and an average is taken of the changes in the angle of the ankle joint when walking on a floor, as shown in FIG. 11. Data were compared for the case where a conventional comparative example sock (control sock) is worn which has no first through fourth low-elasticity area, and the case where a sock of Example 2 is worn. The results are given in the graph of FIG. 12.

Figure 12:
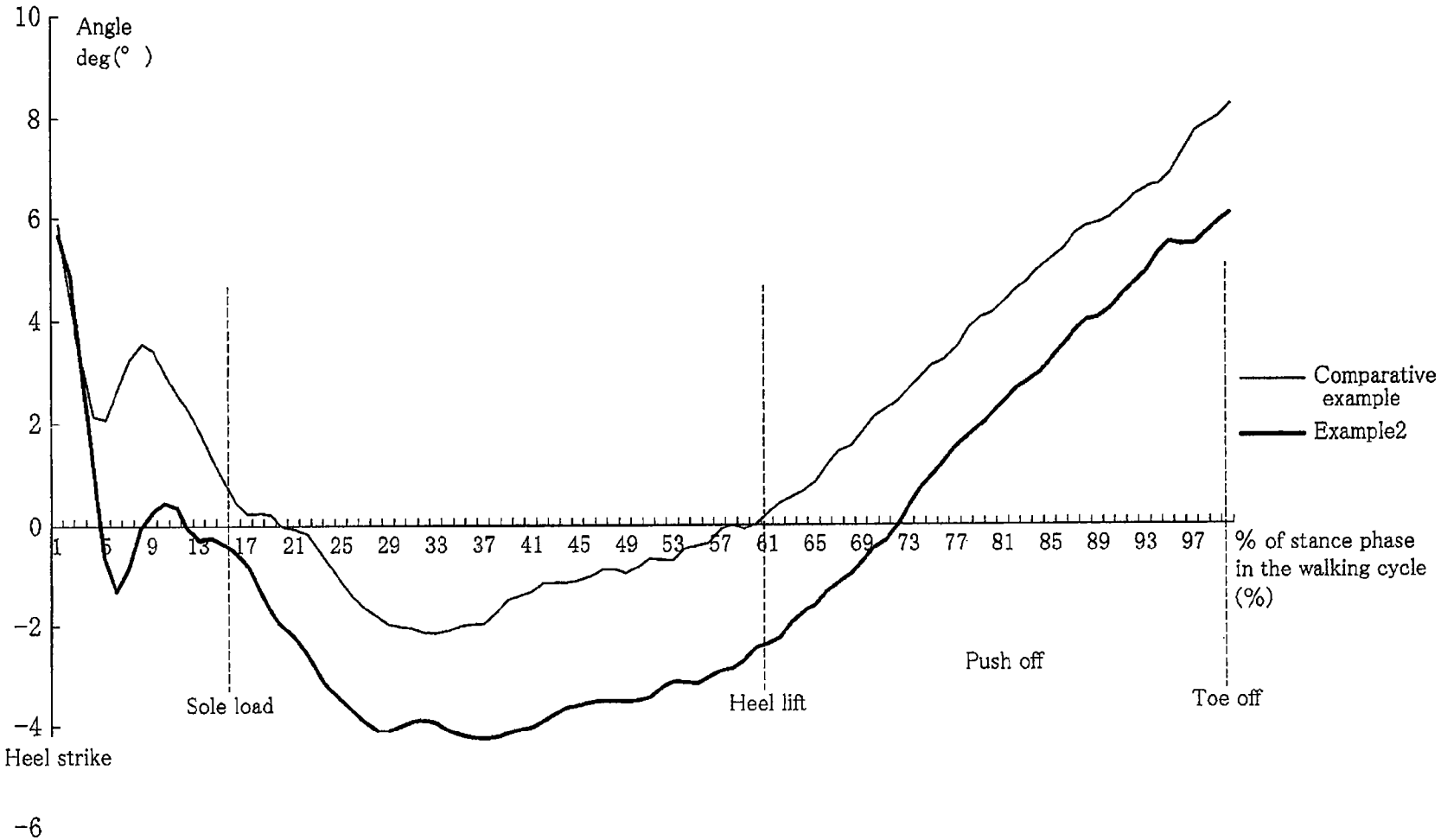
FIG. 12 is a graph showing the results of a joint angle measurement test performed while walking.

The vertical axis of the graph in FIG. 12 is the angle (deg), expressed as "°". The part of the vertical axis lower than 0 with negative values represents angles in the direction of eversion (the direction preventing inversion), and the part of the vertical axis above 0 with positive values represents angles in the direction of inversion. In this test, the more the line in the graph is lower than 0, the greater the effect of preventing inversion sprains.

The horizontal axis of the graph in FIG. 12 is the relative ratio of time in the stance phase, expressed as "%". The stance phase is the time during the walking cycle when a part or all of the foot from the toes to the heel touches the surface of the floor. Typically, this takes up about 60% of the time during the walking cycle. In more detail, this can be divided into various stages: heel strike, sole load, heel lift, and toe off.

As shown in the graph in FIG. 12, when walking while wearing the sock of the present invention, in all of the stages from heel strike to toe off, there was found to be a greater force turning the foot joints in the direction of eversion (the direction preventing inversion), than when wearing an ordinary sock. Therefore, the sock of the present invention was found to have an outstanding inversion sprain preventative effect.

The present invention is not limited to the above examples, and the embodiments can be suitably modified, as long as they are within the scope of the technical ideas recited in the claims.

The invention claimed is:

1. A sock comprising:

a first low-elasticity area disposed on a dorsal portion of the foot, the first low-elasticity area being band-shaped and having a lower elasticity than other areas of the sock, and a second low-elasticity area having lower elasticity than other areas of the sock, excluding the first low-elasticity area, the second low-elasticity area extending from an instep side of a base of a fourth toe to a sole side so as to wrap around a fifth phalange and a fourth phalange, wherein a lower end of the first low-elasticity area is continuous with the second low-elasticity area, wherein the first low-elasticity area comprises at least a curved ankle portion and an end portion, the end portion being disposed below the curved ankle portion and extending to a base of the toes, the end portion being positioned within a range from a base of a third toe to a base of a small toe, and wherein a center line in the course direction with respect to the width of the first low-elasticity area gradually shifts toward the side of the small toe in the course direction, and wherein a portion on a side of the small toe near the lower end of the first low-elasticity area extends to the sole side of the sock such that it wraps around a fifth metatarsal.

2. A sock according to claim 1, wherein the first low-elasticity area and the second low-elasticity area are knitted using tuck knitting.

3. A sock according to claim 1, wherein the width of the first low-elasticity area in the course direction when the sock is in an unworn configuration is in a range between about 4 centimeters to about 5 centimeters.

4. A sock according to claim 1, further comprising a third low-elasticity area having lower elasticity than other areas of the sock, excluding the first and second low-elasticity areas, the third low-elasticity area being disposed peripherally in a vicinity of a lower part of the calf, wherein an upper end of the first low-elasticity area is formed continuously with the third low-elasticity area.

5. A sock according to claim 4, wherein that the width of the third low-elasticity area is about 3 centimeters or more in the wale direction when the sock is in an unworn configuration.

6. A sock according to claim 4, further comprising a fourth low-elasticity area having lower elasticity than other areas of the sock, excluding the first, second, and third low-elasticity areas, the fourth low-elasticity area being disposed peripherally in the vicinity of the lower part of the calf, the lower end of the first low-elasticity area being formed continuously with the fourth low-elasticity area.

7. A sock according to claim 6, further comprising at least two toe pouches in a toe portion.

8. A sock according to claim 7, wherein the toe portion and a heel portion are each knitted with pile knitting.

9. A sock according to claim 8, further comprising an area having an increased course number that encloses a ball of the foot on the sole side of the sock, the area having an increased course number being pile knitted.

* * * * *